United States Patent [19]

Budny

[11] 3,974,947

[45] Aug. 17, 1976

[54] DISPENSING CARTON FOR ROLL MATERIALS

[75] Inventor: Thomas F. Budny, Lisle, Ill.

[73] Assignee: The Dow Chemical Company, Midland, Mich.

[22] Filed: Aug. 8, 1974

[21] Appl. No.: 495,794

Related U.S. Application Data

[63] Continuation of Ser. No. 369,624, June 13, 1973, abandoned.

[52] U.S. Cl. ..... 225/25; 225/49; 225/53

[51] Int. Cl.[2] ..... B26F 3/02

[58] Field of Search ..... 225/25, 26, 48, 49, 225/53; 229/17 R, 17 S; 206/59 E, 59 F, DIG. 18

[56] References Cited

UNITED STATES PATENTS

| | | | |
|---|---|---|---|
| 2,683,529 | 7/1954 | Wauda | 225/53 X |
| 2,783,878 | 3/1957 | Traver | 225/53 X |
| 3,096,918 | 7/1963 | VanDyke et al. | 225/48 |
| 3,549,066 | 12/1970 | Wankow | 225/25 |

*Primary Examiner*—Leon Gilden
*Attorney, Agent, or Firm*—Burke M. Halldorson

[57] ABSTRACT

An improved foldably erected dispensing carton particularly for household wrapping materials such as polymeric film, wax paper, metal foil, and the like, wherein the carton embodies a double ply panel having a pressure sensitive adhesive layer interposed between and securing such plies. An aperture is die-cut or otherwise formed in the outer ply to expose a select area of the adhesive, and thereby present a recessed tack spot to which the leading end of the roll can be lightly adhered, and thus prevented from withdrawing into the carton. The double ply panel structure also makes available a folded edge about which the roll material can be dispensed with minimum chance of snagging or binding due to the smooth quality of such edge.

4 Claims, 4 Drawing Figures

DISPENSING CARTON FOR ROLL MATERIALS

CROSS REFERENCE TO RELATED APPLICATIONS

This is a continuation of application Ser. No. 369,624, filed June 13, 1973, abandoned.

The invention relates to a dispensing carton for materials supplied in roll form, particularly polymeric film, wax paper, metal foil, and like wrapping materials for household and other uses. Particularly the invention relates to a dispensing carton wherein the improvements reside in: (i) a convenience feature which is adapted to prevent withdrawal of the roll end into the carton, and the ensuing difficulties of having to retrieve the "lost" end in order to restart the roll for the next dispensing use; and (ii) a folded edge available from such feature, and about which the roll material can be smoothly dispensed from the carton.

It has been known heretofore to provide dispensing cartons which are foldably erected from flat carton blanks of paper or paperboard materials. One of the recognized problems for cartons of this type, is that the roll, after it is started, is usually not adequately prevented from withdrawing back into the carton. This problem is most objectionable regarding wrapping materials of the general type having an adhesive or "tacky" surface character, since the "lost" end tends to adhere to the roll, and become indistinguishable or nearly so against the background of the roll. Such occurs with some frequency as it is and has been a foremost source of consumer complaints.

A practical solution to this problem has proved difficult in view of the need for strict compliance and compatibility with factors relating to the manufacture and loading of the carton, as well as factors as may be associated with marketing and consumer use aspects.

For example, roll dispensing cartons are manufactured, erected, and loaded at extremely high speeds. Any modification to the carton as would impede its rate of manufacture, or the rate of loading or erecting thereof, would be of doubtful vlaue, since it would materially add to the valve, of the carton, or the cost of erecting and loading the same.

Moreover, the carton shape while it is not necessarily rectangular for dispensing purposes, is near universally rectangular in order that the carton can be displayed and stored compactly on the grocery shelf. Thus, any such modification or solution as would require a change in the shape of the carton, would be practical only for limited use at most.

As yet other qualifications, a truly practical solution or modification to overcome this problem, should be highly functional, its mode of operation readily perceived by the consumer with minimum required attention, and it should not for any reason, add appreciably to the overall costs of the carton, nor detract from its appearance or functionality in other regards.

Accordingly, it is the primary objective of this invention to provide an improved roll dispensing carton having a practical, effective, and inexpensive feature for preventing withdrawal of the leading end of the roll into the carton.

It is another objective of this invention to provide such a carton wherein the retaining feature is highly compatible with the manufacture, printing, erecting, and loading of the carton at commercially acceptable speeds.

It is still another objective of this invention to provide such a dispensing carton wherein such retaining feature can be inclined in the carton design with minimum change required in existing production equipment, and with near 100% reliability.

It is yet another objective of this invention to provide a dispensing carton of the above attributes and character wherein the retaining feature, in addition to its primary function, advantageously presents a folded edge over which the roll material may be smoothly dispensed from the carton, and with minimum chance of snagging or binding against the edge due to the quality thereof.

SUMMARY OF THE INVENTION

Briefly the invention contemplates an improved dispensing carton of a general type including a cutting means such as metal or plastic cutter bar, and means for providing an elongated dispensing opening through which a roll of material can be withdrawn from the carton as needed. The improvement resides in a double ply panel structure having an intermediate or interposed pressure sensitive adhesive layer. An aperture is die-cut or otherwise formed in the outer ply, to expose a small area of the adhesive, and thereby provide a recessed tack spot to which the leading end of the roll can be lightly adhered with or after each dispensing use. As a secondary benefit, such panel structure is used, without added expense, to present a folded edge over which the roll material can be withdrawn or dispensed from the carton with maximum ease, and minimal chance of damage to the material.

Other objectives and advantages of the invention will be more apparent by reference to the following specification taken in view of the accompanying drawings wherein.

DESCRIPTION OF THE EMBODIMENT

Figure 1:
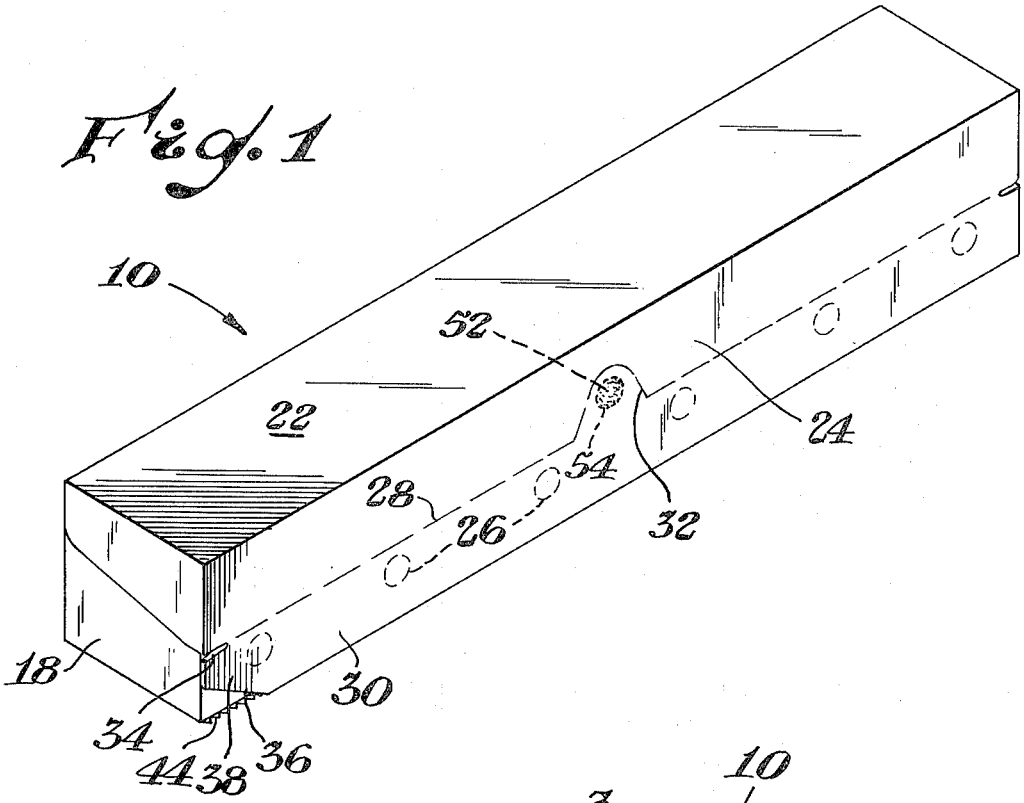
FIG. 1 is an isometric view of a carton constructed according to the general principles and teachings of this invention, and which shows the carton in the form as it would be provided the consumer.

Referring now to FIG. 1, a roll dispensing carton 10, shown in its erected form, comprises foldably connected front, back, and bottom panels, 12 through 16, respectively, and end panels 18 and 20, respectively. A trunk style lid 22 is hingedly connected to the uppermost edge of the back panel. The lid 22 includes a front wall section or portion 24 which overlies nearly the entire extent of the front panel. The lid is free of the front panel except for the lower extent of wall section 24, which is detachably secured thereto along a line of spaced glue spots 26.

Wall section 24 includes a line of perforations or weakness 28 which forms a tear strip 30, whereby that portion of wall section 24, coextensive with glue spots 26, can be selectively removed to open the carton. The line of perforations is essentially straight except for a raised area 32 medial between its ends. The raised area is adapted to lift out a generally thumb sized portion of wall section 24 upon removal of tear strip 30, for reasons as will become evident hereinafter. Preferably there is also provided cut-outs 34 and 36 to form a tab 38 for conveniently grasping the tear strip.

Figure 2:
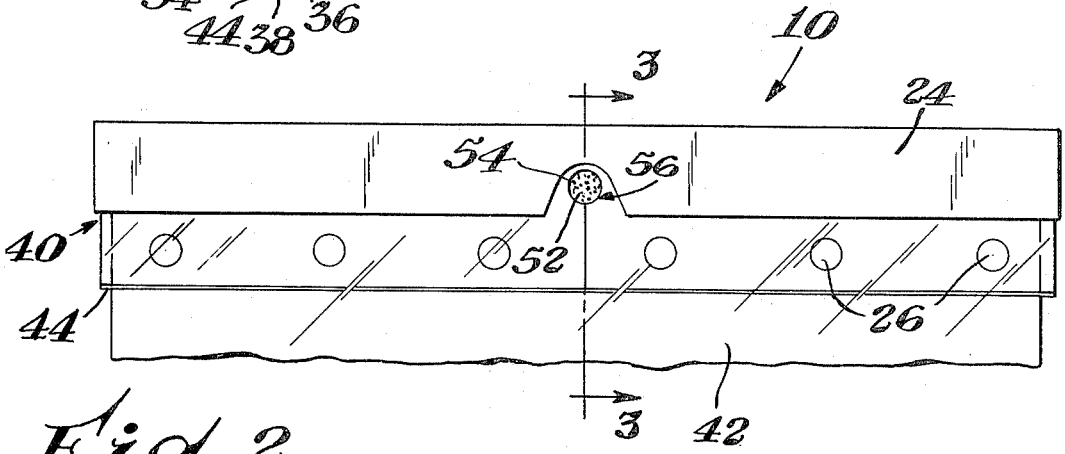
FIG. 2 is a front elevational view of the carton of FIG. 1 after the same has been opened and the carton readied for dispensing the roll material contained therewithin.
Figure 3:
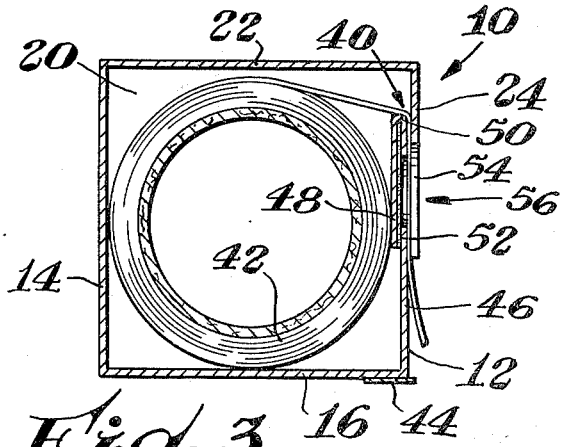
FIG. 3 is a cross-sectional view through FIG. 2 taken along reference line 3—3 thereof.

Upon removal of the tear strip, lid 22 is free to open, and, simultaneously there is provided an elongated opening or dispensing outlet 40, which is defined between the front panel and wall section 24 (see FIGS. 2 and 3). A roll 42 of material contained within carton 10 is prepared for dispensing by opening the lid and withdrawing a short length of the material to start the roll, after which the lid is closed. A cutting means 44, most preferably a metal or plastic cutter bar, is secured along the juncture between the front and bottom panels for controllably tearing off desired lengths of the roll material dispensed from the carton.

The invention particularly resides in the character of front panel 12. The front panel comprises a multi-ply structure including a first or outer ply 46. A second or inner ply 48 is integrally joined to the outer ply along a fold line 50 which is coextensive with the top edge of the front panel. The inner ply extends downwardly in flat, folded relationship against the inner face of outer ply 46, and is secured thereto by means of a pressure sensitive adhesive layer 52. An aperture 54 is die-cut or otherwise formed in outer ply 46 to expose a select area of the adhesive layer. The aperture, together with the adhesive, presents a recessed tack spot 56 on the exterior surface of front panel 12. The thumb size portion removed from lid 22, as mentioned above, permits access for the user's thumb to press the roll material against the tack spot simultaneously with each cut-off or dispensing use. The residual end of the roll is thus conveniently seated in the tack spot where it remains lightly adhered and ready for the next dispensing use.

The character and quality of the top edge of the front panel is also an important attribute which is provided without additional expense in cartons constructed according to these teachings. The folded smoothness of this edge provides an ideal surface over which the roll material can be dispensed with minimal chance of snagging, binding, or other possible damage to the material, particularly if it is of a delicate, tear propagating nature.

Figure 4:
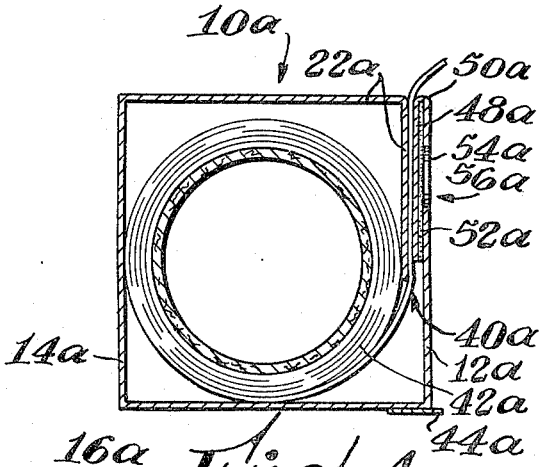
FIG. 4 is a view like FIG. 3 only showing a modified form of the invention.

A modified embodiment of the invention is illustrated in FIG. 4 in the form of carton 10*a*. Carton 10*a* includes a multi-ply front panel 12*a* including an intermediate or interposed pressure sensitive adhesive layer 52*a*, and an aperture that provides communication between the adhesive layer and the exterior surface of front panel 12*a*, thus presenting thereon a tack spot 56*a*. The lid 22*a* is of the general type adapted to be tucked behind the front panel, after opening the carton by tear strip means or otherwise, thereby providing a dispensing outlet or opening 40*a* through which roll material 42*a* can be withdrawn from the carton. The material 42*a* is dispensed about the smooth folded edge of the front panel, to the location of a cutting means 44a therebeneath, whereby the user with each dispensing cut-off, can seat the roll material into the tack spot, thus providing sure retention of the roll end exterior of the carton in the general manner as described before.

The many advantages of the invention include its near perfect compatibility with equipment for producing cartons of the type contemplated. For example, the fabrication steps called for by this invention contemplate folding, scoring, and adhesive applying steps that are generally in like character to steps performed on existing carton fabricating equipment, at high production speeds.

Still as a further advantage, the tack spot is readily located in an area that it will remain concealed and protected until the carton is opened by the consumer. Also the recessed character of the tack spot ensures that it will not objectionably interfere with the dispensing of the roll material from the carton.

Moreover, it can be appreciated that the material costs of this end retaining feature do not add unreasonably to the costs of providing the carton. It is particularly also an advantage that the adhesive can be colored or otherwise marked or designated so that it stands out from the background of the carton, and together with appropriate printed instructions, its use will be obvious to the consumer with minimum attention.

Understandably, the term "pressure sensitive adhesive" is employed herein in the broad sense to cover any composition or material having adequate affinity for the roll material contained within the carton to operate as a retention feature in the manner contemplated above. Most optimally, however, the adhesive will also serve to secure the folded ply structure hereof in which the same is interposed as an intermediate layer or ply. As an illustrative example only, a preferred adhesive composition having affinity for saran household wrapping materials, comprises an acrylic type emulsion polymer available from the H. B. Fuller Company under the trade designation "E-4716."

While the preferred embodiments of the invention have been shown with regard to specific details and carton designs, it will be appreciated that depending on the carton design and the manufacturers' desires, the invention may be modified by various changes while still being fairly within the scope of the general teachings and principles hereof.

I claim:

1. In a dispensing carton for roll material wherein there is generally provided, means for forming an exit opening for withdrawing the material from the carton, and cutting means for cutting off lengths of the dispensed material, the improvement which comprises, a panel comprising at least two plies and presenting a folded edge along said exit opening, and over which said material can be smoothly withdrawn from the carton, a pressure sensitive adhesive material interposed between said plies, an aperture formed through the outermost of said plies to expose the adhesive at the surface of the carton, and thereby provide a tack spot which is recessed to minimize any contamination thereof, and to which the leading end of the roll material can be adhered to prevent its inadvertent withdrawal into the carton.

2. The dispensing carton of claim 1 wherein said tack spot is conveniently located intermediate said exit opening and cutting means.

3. The dispensing carton of claim 2 wherein the same includes front, rear, and bottom panels, and end panels forming a generally rectangular enclosure in which the roll material is contained, a lid hingedly connected to the uppermost extent of the rear panel and adapted to form together with the front panel an exit opening for dispensing the material, a cutting means located adjacent the juncture of the front panel and bottom panel, and wherein said tack spot resides on the exterior face of said front panel.

4. The carton of claim 3 wherein said carton includes a lid having a portion thereof overlying at least a part of the front panel, the lid having a line of weakness defining a removable tear strip securing the lid to the front panel, and wherein said tack spot is positioned to remain concealed behind the lid until the tear strip portion thereof is removed.

* * * * *